United States Patent [19]

Savage et al.

[11] 4,011,946

[45] Mar. 15, 1977

[54] MERCHANDISE PACKAGING DEVICE

[75] Inventors: Sidney Savage, Canton, Ohio; Thomas J. Ham, Stone Mountain, Ga.

[73] Assignee: The Akro Corporation, Canton, Ohio

[22] Filed: Nov. 24, 1975

[21] Appl. No.: 634,415

[52] U.S. Cl. ..... 206/284; 206/527; 206/806; 206/44 R

[51] Int. Cl.[2] ..... B65D 85/00

[58] Field of Search ..... 206/44 R, 45.14, 284–287, 206/449, 491, 494, 526–527, 801, 806; 223/87

[56] References Cited

UNITED STATES PATENTS

| | | | |
|---|---|---|---|
| 3,841,478 | 10/1974 | Wells et al. | 206/527 X |
| 3,862,687 | 1/1975 | Pirman | 206/806 X |

*Primary Examiner*—Steven E. Lipman
*Attorney, Agent, or Firm*—Teare, Teare & Sammon

[57] ABSTRACT

A merchandise packaging and display device for floor mats, and the like. The device comprises a sheet of paper board shaped to be folded over a marginal edge portion of a floor mat and which is then secured thereto by staples. The paper board has a slot for receiving the neck of a hanger by means of which the assembly may be suspended from a horizontal pole or bar. The hanger has arms which extend outwardly from the base of the neck portion and fit within the space between the top edge of the mat and the folded portion of the paper board. Sufficient clearance is provided so that the hanger may be rotated with reference to the paper board support, whereby the neck and head of the hanger may be moved into a position where they lie substantially flush with the paper board support, so as to reduce the over-all size of the carton in which the mats may be transported. The assembly enables mats to be displayed vertically.

1 Claim, 3 Drawing Figures

MERCHANDISE PACKAGING DEVICE

BACKGROUND OF THE INVENTION

One form of device for displaying floor mats is shown in U.S. Pat. No. 3,841,478 which illustrates a sheet of material folded to form two superimposed portions for receiving a mat therebetween. The paper board has a projection in the mid-portion in which a notch is formed for engaging a supporting rod or bar, but such projecting portion is rigidly connected to the side portions and projects beyond the marginal edge of the mat, thereby increasing the over-all dimension of the package or carton in which the mats are transported.

SUMMARY OF THE INVENTION

The invention of the present application includes a support member in the form of a sheet of material such as paper board which is folded over to provide parallel side portions and an intermediate bight or connecting portion. The side portions are attached to a floor mat adjacent the top edge thereof, with a space between the edge of the mat and the intermediate connecting portion, in which the arms of a hanger type of member may be mounted. The hanger may be positioned with reference to the support member so as to suspend the mat in vertical position for display purposes, but for transporting purposes, the hanger may be rotated with reference to the support member to lie flat against the support member and thereby reduce the over-all dimension of the assembly.

DESCRIPTION OF THE INVENTION

In the invention, the device, designated generally at 2, includes a support member 4 which is adapted for operable coaction with a hanger member 6 to suspend a carpet mat, or the like, for vertical display.

Figure 1:
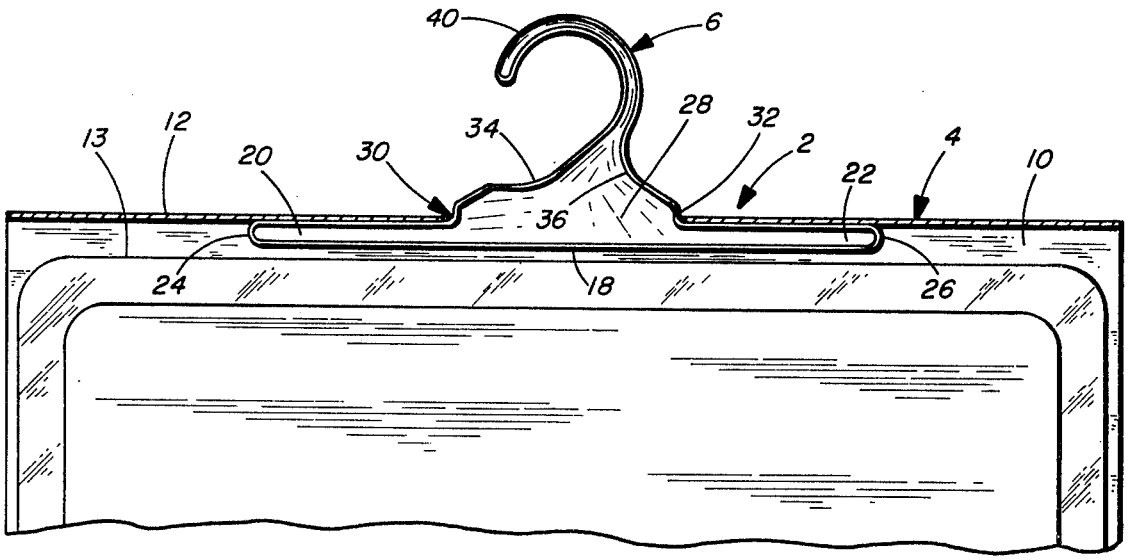
FIG. 1 is a vertical section through a mat support showing the mat and hanger in front elevation view.

The support member 4 may be made of suitable lightweight material, such as heavy paper, cardboard, or the like, having sufficient strength characteristics for supporting a floor mat. In the form shown, the support member comprises a sheet of material of substantially rectangular configuration, as shown in side elevation in FIG. 1, which is bent intermediately to provide a pair of oppositely disposed sides 8 and 10, which are connected by a bight portion 12. In use, the support member has a generally inverted U-shaped configuration (FIG. 3) wherein the bight 12 lies in confronting engagement with the marginal edge 13 of a floor mat 5. The sides may be fastened, as at 15 and 16, to the confronting exterior sides of the mat by suitable fasteners, such as staples, or the like. By such arrangement, the sides of the support may be quickly and easily torn off the mat, whenever one desires to remove the mat from the supporting rack.

The hanger member 6 preferably is made of plastic resinous material such as polyurethane and includes a base 18, which has a pair of substantially rigid oppositely extending arms 20 and 21, which are rounded as at 24 and 26, respectively, at their ends to facilitate operation of the assembly. The hanger has a body portion 28 which extends upwardly from the base by generally upwardly extending side edges 30 and 32, which are shown as being at right angles to the arms 20 and 22, respectively, and which merge by curved edges 34 and 36, respectively, into a curved hanger portion 40.

The hanger portion 40 is illustrated as having a semi-closed configuration of a generally C-shape which is adapted for mounting over a hanger rod on a display rack. In this form, the base 18, the body 28 and the hanger portion 40 are provided on both sides of the body with a peripherally continuously upstanding marginal edge as at 42 and 44, respectively, (FIG. 3) for strengthening the hanger, and for providing a smooth surface which is comfortable to the grasp of one who handles the assemblies for insertion upon and removal from a display rack.

In the invention, the support member may have a windowlike polygonal opening, as at 50, for receiving the body 28 of the hanger which projects upwardly above the support. As shown, the opening 50 includes a cutout portion 52 which is defined by oppositely disposed end edges 54 and 56 and a bottom edge 58. The bottom edge is joined to the end edges by inclined linear edges 60 and 62, respectively. Preferably, for a mat having a width of about 16 inches, the opening 50 has a depth D of about one inch and the hanger arms have a depth W of about ⅜ inch. By such arrangement, the hanger can be quickly and easily inserted upwardly through the opening 50 before the support is attached to a floor mat. The sides of the support are then stapled to the mat, leaving a space S between the top edge 13 of the mat and the bight 12 of about ¾ of an inch.

Figure 3:
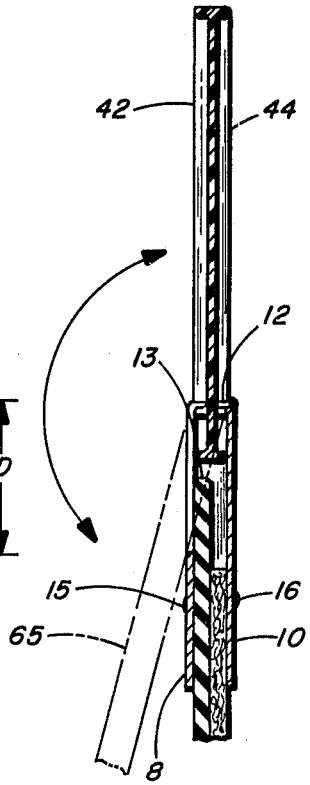
FIG. 3 is a section taken on a plane indicated by the line 3—3 in FIG. 2.

When the arms of the hanger engage the underside of the bight 12, the hanger may be rotated downwardly from the full line position to the broken line position 65 in FIG. 3. At such time, there is adequate space between the bight and the top of the mat to enable the hanger to lie flat against the mat, thus presenting a substantially over-all rectangular shape which facilitates packaging the shipment.

Figure 2:
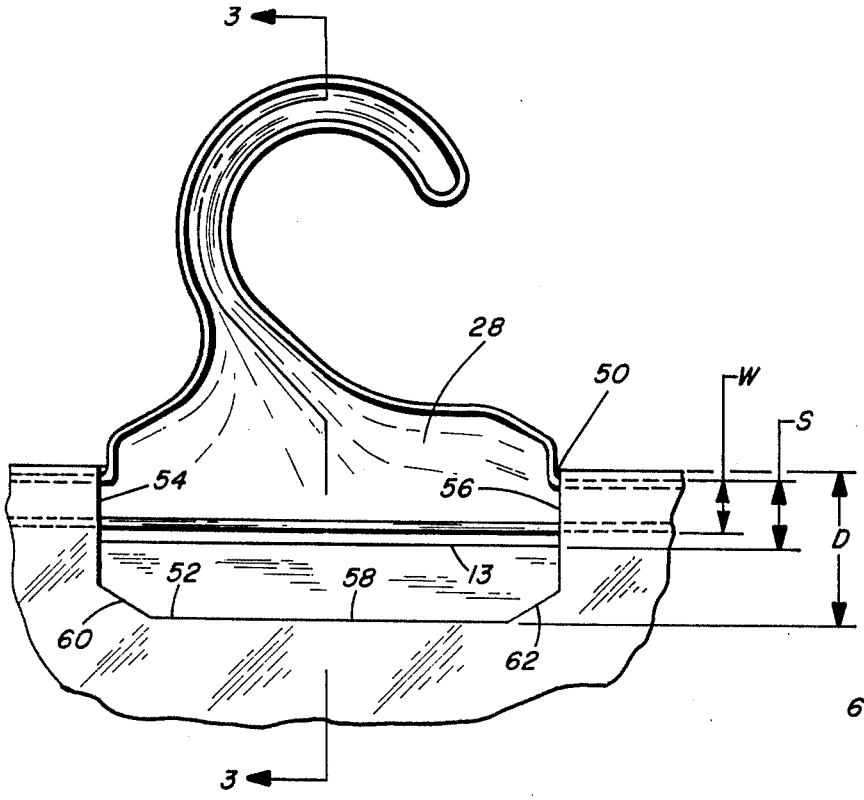
FIG. 2 is a back elevation of a portion of the assembly on a scale larger than that of FIG. 1.

Whenever the assembly is to be displayed, the hanger can be rotated to the upright position, as shown in FIG. 2, and hung upon a display rack.

An advantage of the present invention is that a combination of support and hanger enables floor mats to be displayed in vertical position, where each mat may be swung outwardly for inspection by a perspective purchaser for selection as to color and design. Whenever an assembly is removed from a rack, the hanger can be swung downwardly so as to lie flat against the mat and thereby be suitably packaged for the customer.

I claim:

1. A device for displaying floor mats and the like in vertical position wherein a sheet of flexible material is folded to form two side panels and a connecting web and wherein the web has a circular opening and wherein a hanger has a central portion which extends upwardly through the opening and terminates in a hook and has a pair of arms extending outwardly from the central portion which engage the underside of the web, and wherein the side panels receive the mat to be displayed, wherein the improvement comprises, the connecting web has a slot adjacent the mid portion thereof and one of the side panels has a slot which communicates with the slot in the web, the hanger has an elongated flat central portion together with arms which extend in opposite directions from the central portion, the arms of the hanger occupy the space between the connecting web and the upper edge of the mat and the central portion of the hanger projects through the slot in the web, and the slot in the side panel has an area sufficient to receive the flat central portion of the hanger, whereby the hanger together with the arms when rotated can be positioned downwardly in a direction toward said panel.

* * * * *